US007070045B2

(12) United States Patent
Theelen

(10) Patent No.: US 7,070,045 B2
(45) Date of Patent: Jul. 4, 2006

(54) CONTAINER FOR ARTICLES

(75) Inventor: Marcus Theelen, Kreuzau-Winden (DE)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

(21) Appl. No.: 10/301,160

(22) Filed: Nov. 21, 2002

(65) Prior Publication Data

US 2003/0111363 A1 Jun. 19, 2003

(30) Foreign Application Priority Data

Dec. 15, 2001 (GB) ..... 0130089.6
Feb. 12, 2002 (GB) ..... 0203216.7

(51) Int. Cl.
*B65D 75/00* (2006.01)

(52) U.S. Cl. ..... 206/188; 206/180; 206/175; 206/172; 206/427

(58) Field of Classification Search ..... 206/162–166, 206/170, 172, 175, 180, 188, 427
See application file for complete search history.

(56) References Cited

U.S. PATENT DOCUMENTS 2,373,851 A 4/1945 Potter ..... 224/45
2,457,308 A 12/1948 Hall et al. ..... 224/45
2,807,389 A 9/1957 Strauss ..... 220/105
5,595,291 A * 1/1997 Negelen ..... 206/162
5,975,287 A * 11/1999 Negelen ..... 206/162
6,168,013 B1 1/2001 Gomes ..... 206/162

FOREIGN PATENT DOCUMENTS

| | | |
|---|---|---|
| GB | 939648 | 10/1963 |
| GB | 1 584 838 | 2/1981 |
| GB | 2 242 675 | 10/1991 |
| WO | WO 98/19932 | 5/1998 |

* cited by examiner

*Primary Examiner*—Mickey Yu
*Assistant Examiner*—J. Gregory Pickett
(74) *Attorney, Agent, or Firm*—Womble Carlyle Sandridge & Rice, PLLC

(57) ABSTRACT

There is provided a basket style bottle carrier having a lengthwise central wall 30, 31 and receiving compartments for bottles 12 on each side of the central wall. A handle portion 14, which is separate from the central wall 30, 31, is connected to the remainder of the carrier device by interconnecting webs 17 extending from the side walls 23 of the compartments. The handle 14 is movable relative to the central wall 30, 31 between raised and lowered positions. In some arrangements the handle portion 14 has a downwardly extending portion 21 with hook formations 22 for engaging in notches 38 to retain the handle 14 in its lowered position.

11 Claims, 4 Drawing Sheets

CONTAINER FOR ARTICLES

RELATED APPLICATION

This application claims priority under 35 U.S.C. §119(b) to British application, Ser. No. 0130089.6, filed on Dec. 15, 2001, and British application, Ser. No. 0203216.7, filed on Feb. 12, 2002.

FIELD OF THE INVENTION

This invention relates to containers for articles and more particularly to basket style containers usually for carrying bottles. Basket style containers are known and normally have a central lengthwise extending wall which leads into an upstanding handle portion. On each side of the central wall is an open topped compartment section for receiving a number of bottles. Further divider walls are also provided inside each compartment section so as to define individual pockets for each bottle. When fully erected, the container has a base, a pair of end wall means generally perpendicular to the central wall and a pair of side walls generally parallel to the central wall and hingedly connected to the end walls.

It is common for the containers to be supplied to an end user, such as a beverage manufacturer, in a flat condition either fully glued or glued except for a pair of base panels. The end user then runs the containers on a packing machine which opens the containers and inserts the bottles, having closed the base panels where necessary.

SUMMARY OF THE INVENTION

According to a first aspect of the present invention there is provided a paperboard basket type carrier device having a lengthwise extending central wall, article receiving compartments on both sides of the central wall and a handle portion, each receiving compartment being defined by a base wall, a side wall substantially parallel to the central wall, a pair of end walls extending between and hingedly connected to the side wall, and the central wall with compartment dividers being folded out from the central wall and adhesively secured to the side walls, said handle portion being separate from the central wall, being movable relative thereto between a raised position and a lowered position and being connected to the remainder of the carrier device by means of interconnecting webs extending from the pair of side walls.

Preferably an interconnecting web is provided at each lengthwise end of each side wall.

In preferred arrangements there is provided a releasable interconnection between the handle portion and the remainder of the carrier device to retain the handle portion in its lowered position. Ideally said releasable interconnection comprises a hook formation on a downward extension of the handle portion and a cooperating notch formed in one of the compartment dividers at a location adjacent the central wall. Conveniently a notch is provided in the compartment dividers on each side of the central wall. In preferred embodiments the downward extension of the handle has two oppositely directed hooks, one at each lengthwise end, and cooperating notches are provided in the compartment dividers.

In order to facilitate movement of the handle portion between its raised and lowered positions, creases may be formed in the interconnecting webs. Also, the interconnecting webs may be of multiple thickness.

BRIEF DESCRIPTION OF THE DRAWINGS

An embodiment of the present invention will now be described in more detail. Reference is made to the enclosed drawings in which.

DETAILED DESCRIPTION

Figure 1:
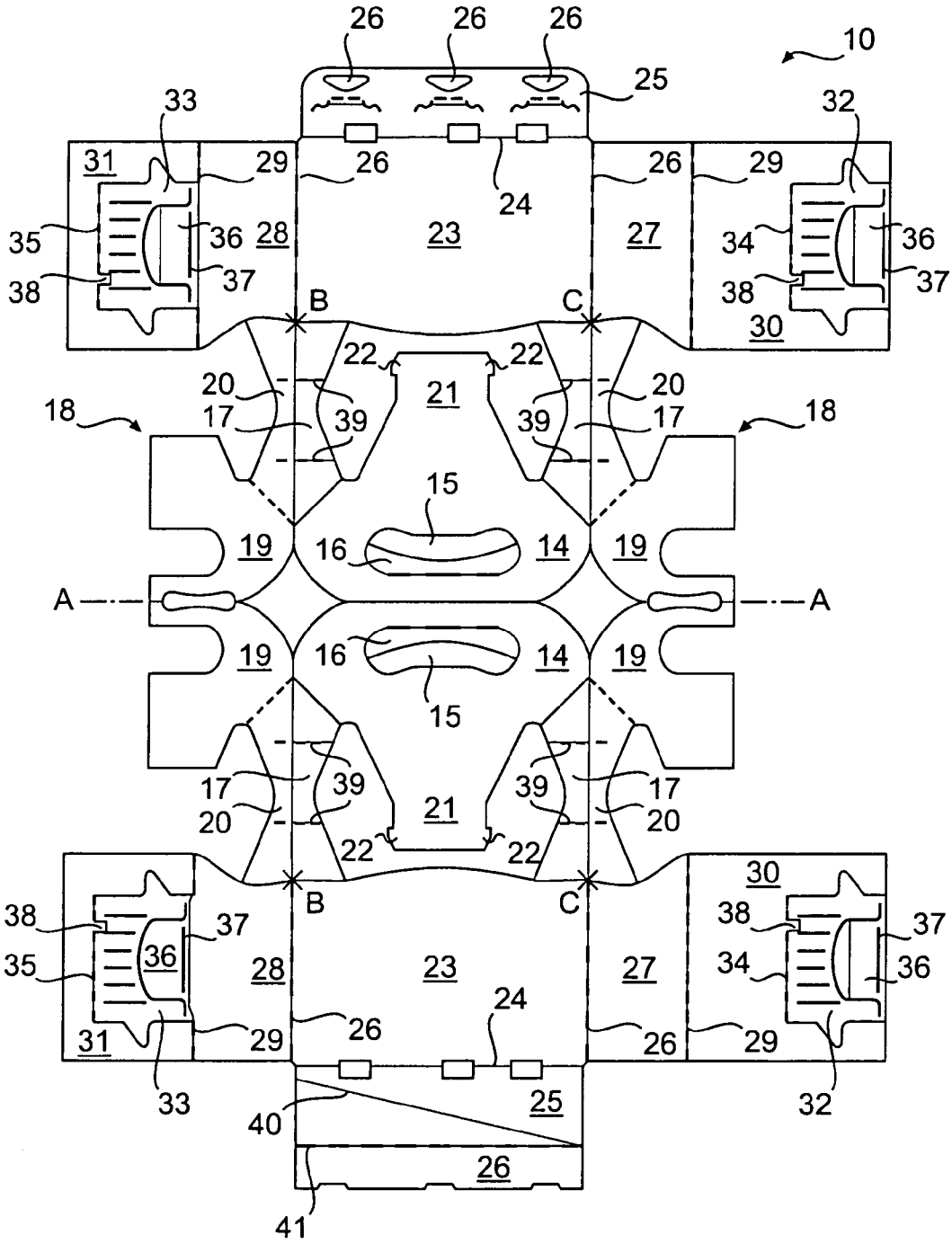
FIG. 1 shows a blank for producing a basket type carrier device according to the present invention.
Figure 2:
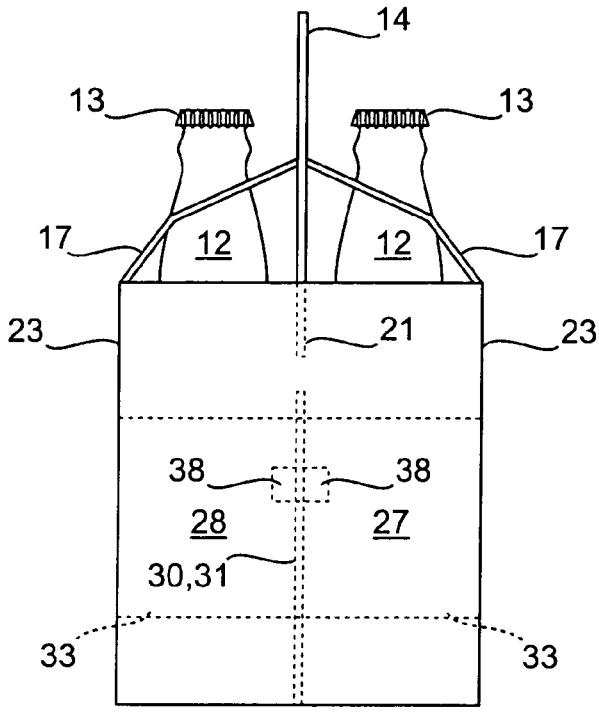
FIG. 2 is an end view of a loaded carrier device with the handle in a raised position.
Figure 3:
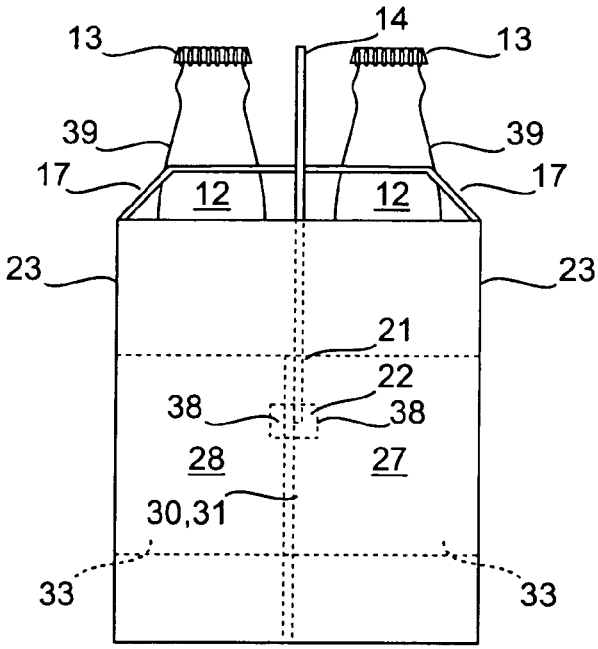
FIG. 3 is an end view of a loaded carrier device with the handle in a lowered position.
Figure 4:
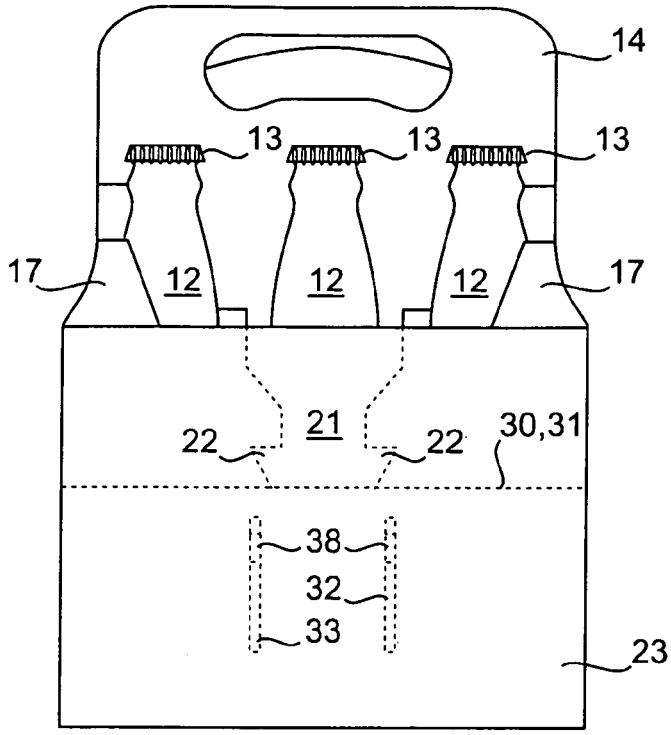
FIG. 4 is a side view of the FIG. 2 arrangement.
Figure 5:
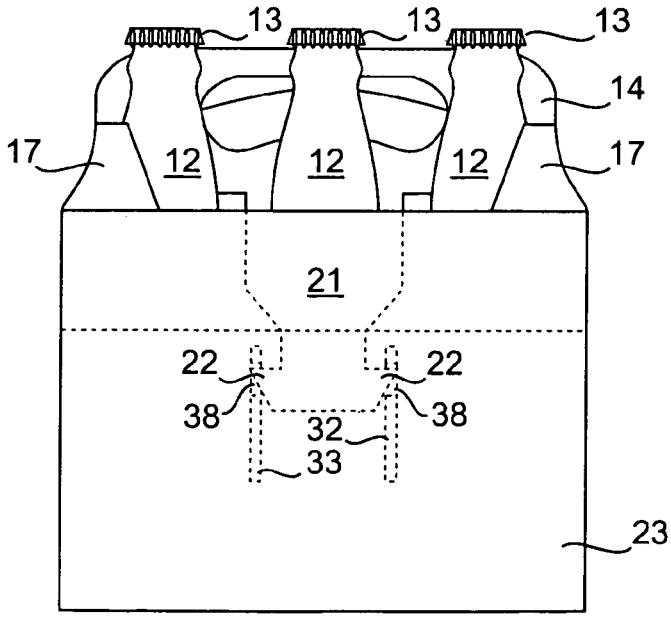
FIG. 5 is a side view of the FIG. 3 arrangement.
Figure 6:
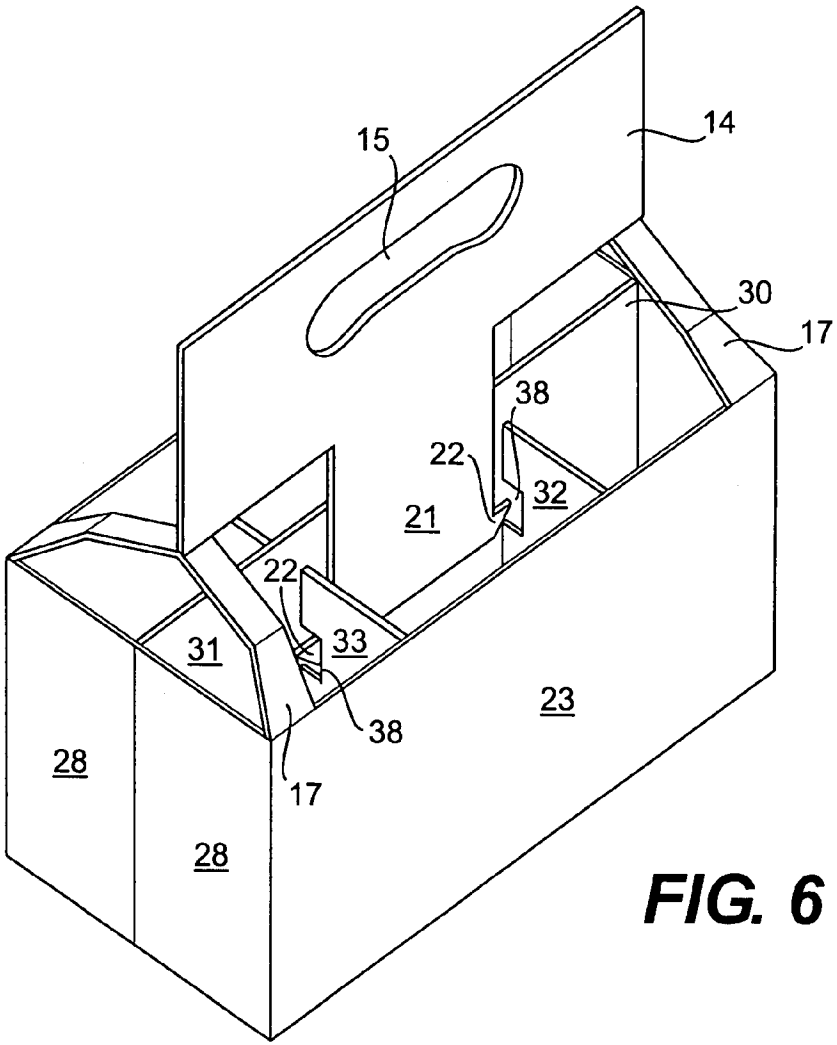
FIG. 6 is a perspective view of the FIG. 3 arrangement.

In the figures there is shown a paperboard blank 10 for producing a basket-type carton 11 for carrying a number of articles as a multipack. In the arrangement shown, the articles are bottles 12 having bottle closures 13 and the carton 11 is designed to carry a total of six bottles 12 in two rows of three. It will be evident on reading the specification, however, that other articles could be carried and there could be more than three articles in each row.

The blank 10 provides two main handle panels 14 which are connected along a fold line A—A. The main handle panels 14 each have a handle aperture 15 complete with a tuck flap 16 which is known for providing added comfort when the loaded carton 11 is being carried. Each main handle panel 14 is hingedly connected at each lengthwise end to an interconnecting web 17. Reinforcing panels 18 which have handle reinforcing portions 19 and web reinforcing sections 20 are hingedly connected to the respective main handle panels 14 and to the interconnecting webs 17 along fold lines B—B and C—C. Each main handle panel 14 also has an extension 21 which terminates in a pair of oppositely disposed hook formations 22.

Each interconnecting web 17 is hingedly connected at its end remote from the handle panel 14 to a side wall 23 which in turn is hingedly connected at its lower edge 24 to a base panel 25. The base panels 25 have formations 26 to enable the two base panels to be interlocked when the carton 11 is assembled. Alternative interlocking formations could be employed or the two base panels 25 could be adhesively secured together. Each side wall 23 has an interconnecting web 17 at each lengthwise end. The larger base panel 25, shown lowermost in FIG. 1, has a diagonal crease 40 extending at one end from a lengthwise fold 41 which is centrally disposed between the side walls 23 when the carton is assembled.

At each end edge 26 of each side wall 23 a partial end wall 27, 28 is hingedly connected. Hingedly connected along folds 29 to each partial end wall 27, 28 is a partial centre wall 30, 31. Lateral dividers 32, 33 are cut from the partial centre walls 30, 31 to be hinged about folds 34, 35. Each lateral divider 32, 33 has an adhesive tab 36 cut therefrom which tab is hingedly connected to the lateral divider by means of fold 37. In each lateral divider 32, 33, adjacent the respective folds 34, 35 a notch 38 is cut.

Assembly of the carton 11 is as follows. Firstly the reinforcing panels 18 are folded about folds B—B and C—C and adhesively secured to the inside of the main handle panels 14 and the interconnecting webs 17. Next, the partial centre walls 30 are folded through 180° about folds 29 so as to lie against the adjacent partial end wall 27 and the side wall 23. Glue is applied to the adhesive tabs 36 of the lateral dividers 32 to secure them to the respective side walls 23.

The other partial centre walls 31 together with their associated partial end walls 28 are then folded through 180° about the edges 26. Again, glue is applied to the adhesive tab 36 of the lateral dividers 33 to secure them to the respective side walls 23. The innermost part of the partial centre wall 31 is also adhesively secured to the part of the other partial centre wall 32 where they overlap.

The part-assembled carton 11 is then folded about fold A—A and the two reinforced handle panels 14 are adhesively secured to each other, as are the extensions 21. Also adhesively secured together are the parts of the partial centre walls 30, 31 around, but not including, the lateral dividers 32, 33. The base panels 25 can then be secured relative to each other either before or after bottles have been inserted into the article receiving compartments defined by the partial end walls, the centre wall, the side walls and the base panels.

It will be clear that the assembled carton 11 can in this embodiment be assembled into a flat condition which can be opened up when articles are to be inserted.

When the carton 11 is opened up, the notches 38 are opened up. The handle section 14, 21 is attached to the article receiving compartments only by means of the four reinforced interconnecting webs 17. The handle section 14, 21 is, therefore, movable up and down relative to the centre wall 30, 31 of the carton 11. The extension 21 which, when assembled, extends downwardly from the main handle panels 14 is dimensioned such that its hook formations 22 can engage in the notches 38 so as to retain the handle section 14, 21 in a lowered position. Ideally with the bottles 12 inserted, the main handle panels 14 do not project above the bottles when the handle section 14, 21 is in its lowered position. This is ideal for storage and stacking.

An end user can, however, grasp the handle by way of the handle apertures 15 and lift the handle. The interengagement of the hook formations 22 in the notches 38 is readily overcome to allow the handle section 14, 21 to move upwardly such that the handle apertures 15 are above the bottles 12. Optional creases 39 in the interconnecting webs 17 may be provided to facilitate the movement between the lowered and raised positions. The diagonal crease 40 in the base provides stiffening and strengthens the base to reduce bowing when loaded.

The carton 11 illustrated has a four ply handle area 14 with reinforced webs 17, but the reinforcement may not be necessary depending on the weight to be carried and the strength of the paperboard. Similarly, only one notch 38 could be provided with only one corresponding hook formation 22 on the downward extension 21. Also, the carton 11 could be readily modified to carry more or even less bottles than the six illustrated.

While preferred embodiments of the invention have been disclosed in the foregoing specification, it will be understood by those skilled in the art that variations and modifications can be made thereto without departing from the spirit and scope of the invention as set forth in the following claims.

The invention claimed is:

1. A paperboard basket type carrier device comprising a lengthwise extending central wall, article receiving compartments on both sides of the central wall and a handle portion, each receiving compartment being defined by a base wall, a side wall substantially parallel to the central wall, a pair of end walls extending between and hingedly connected to the side wall, and the central wall with compartment dividers being folded out from the central wall and adhesively secured to the side walls, the handle portion being separate from the central wall, being movable relative thereto between a raised position and a lowered position, and being connected to the side walls of the carrier device by means of interconnecting webs extending from the pair of side walls, and a releasable interconnection between the handle portion and the dividers of the carrier device to retain the handle portion in its lowered position, wherein a weight of carrier contents is capable of causing release of the releasable interconnection upon upward lifting of the handle portion.

2. A carrier device as claimed in claim 1 wherein an interconnecting web is provided at each lengthwise end of each side wall.

3. A carrier device as claimed in claim 1 wherein said releasable interconnection comprises a hook formation on a downward extension of the handle portion and a cooperating notch formed in one of the compartment dividers at a location adjacent the central wall.

4. A carrier device as claimed in claim 3 wherein a notch is provided in the compartment dividers on each side of the central wall.

5. A carrier device as claimed in claim 3 wherein the downward extension of the handle portion has two oppositely directed books, one at each lengthwise end, and cooperating notches are provided in the compartment dividers.

6. A carrier device as claimed in claim 1 wherein the interconnecting webs are of multiple thickness.

7. A carrier device as claimed in claim 1 wherein creases are provided in the interconnecting webs to facilitate movement of the handle portion between its raised and lowered positions.

8. The carrier device as claimed in claim 2 wherein the interconnecting webs are of multiple thicknesses.

9. The carrier device as claimed in claim 2 wherein creases are provided in the interconnecting webs to facilitate movement of the handle portion between its raised and lowered positions.

10. The carrier device as claimed in claim 1 wherein the carrier contents comprise at least one container, and wherein the handle portion has a handle aperture that is disposed below a top portion of the at least one container in the lowered position and disposed above the top portion of the at least one container when the handle portion is moved to the raised position, and wherein a weight of the at least one container causes the handle portion to move from the lowered position to the raised position upon upward lifting of the handle portion.

11. The carrier device as claimed in claim 1 wherein the carrier contents comprise at least one container, and wherein the handle portion has an upper fold line that is disposed at a height that is equal to or less than a height of an upper portion of the at least one container in the lowered position and the upper fold line is above the of the at least one container when the handle portion is moved into the raised position, and wherein a weight of the at least one container causes is the handle portion to move from the lowered position to the raised position upon upward lifting of the handle portion.

* * * * *